US007322432B2

(12) United States Patent
Rogers et al.

(10) Patent No.: US 7,322,432 B2
(45) Date of Patent: Jan. 29, 2008

(54) FLUID DIVERTER TOOL AND METHOD

(75) Inventors: Henry E. Rogers, Duncan, OK (US); Nicholas C. Braun, Duncan, OK (US); Steven L. Holden, Fletcher, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 277 days.

(21) Appl. No.: 11/004,421

(22) Filed: Dec. 3, 2004

(65) Prior Publication Data

US 2006/0118336 A1 Jun. 8, 2006

(51) Int. Cl.
*E21B 21/00* (2006.01)

(52) U.S. Cl. ..... 175/232; 175/215

(58) Field of Classification Search ..... 166/386, 166/185, 334.1, 334.4, 285, 222; 175/65, 175/171, 215, 232
See application file for complete search history.

(56) References Cited

U.S. PATENT DOCUMENTS

| | | | | |
|---|---|---|---|---|
| 2,128,352 | A | 8/1938 | Creighton | 255/28 |
| 2,602,510 | A | 7/1952 | Baker | 166/1 |
| 2,791,279 | A | 5/1957 | Clark, Jr. | 166/225 |
| 2,846,015 | A | 8/1958 | Pittman | 166/320 |
| 2,847,074 | A | 8/1958 | Maly et al. | 166/325 |
| 2,928,470 | A | 3/1960 | Baker | 166/154 |
| 2,947,363 | A | 8/1960 | Sackett et al. | 166/318 |
| 2,998,075 | A | 8/1961 | Clark, Jr. | 166/318 |
| 3,385,370 | A | 5/1968 | Knox et al. | 166/317 |
| 3,554,281 | A | 1/1971 | Ceuer | 166/155 |
| 3,559,734 | A | 2/1971 | Pitts | 166/224 |
| 5,641,021 | A | 6/1997 | Murray et al. | |
| 5,911,285 | A * | 6/1999 | Stewart et al. | 175/317 |
| 5,960,881 | A | 10/1999 | Allamon et al. | |
| 6,082,459 | A | 7/2000 | Rogers et al. | |
| 6,182,766 | B1 | 2/2001 | Rogers et al. | |
| 6,318,472 | B1 | 11/2001 | Rogers et al. | |
| 6,390,200 | B1 | 5/2002 | Allamon et al. | |

(Continued)

FOREIGN PATENT DOCUMENTS

| | | |
|---|---|---|
| GB | 2 309 470 A | 1/1997 |

(Continued)

OTHER PUBLICATIONS

Foreign communication from related counter part application dated Nov. 17, 2005.

*Primary Examiner*—Jennifer H. Gay
*Assistant Examiner*—Brad Harcourt
(74) *Attorney, Agent, or Firm*—John W. Wustenberg; McAfee & Taft

(57) ABSTRACT

The present invention relates to a diverter tool used in a pipe string used to lower a liner and a cutting apparatus on the end thereof into a partially cased wellbore. The diverter tool has a diverter body that defines a longitudinal flow passage and has the diverter ports defined therethrough to communicate a drilling fluid displaced through the pipe string into the liner into an annular space around the diverter tool. The diverter tool has a closure member so that when the wellbore is drilled to its desired depth, the diverter ports through which drilling fluid is diverted may be closed and the liner may be cemented in the wellbore.

10 Claims, 2 Drawing Sheets

U.S. PATENT DOCUMENTS

| | | | | |
|---|---|---|---|---|
| 6,920,930 | B2 * | 7/2005 | Allamon et al. | 166/318 |
| 2002/0005299 | A1 | 1/2002 | Estep et al. | |
| 2004/0000406 | A1 * | 1/2004 | Allamon et al. | 166/373 |
| 2004/0118614 | A1 | 6/2004 | Galloway et al. | |
| 2004/0134664 | A1 * | 7/2004 | Gudmestad et al. | 166/373 |
| 2004/0221997 | A1 | 11/2004 | Giroux et al. | |

FOREIGN PATENT DOCUMENTS

| | | |
|---|---|---|
| WO | WO 2004/038170 A1 | 5/2004 |

* cited by examiner

FLUID DIVERTER TOOL AND METHOD

BACKGROUND

The present invention is directed to a diverter tool for diverting fluid from a work string to the annular space around the work string and more specifically is directed to a diverter that can be used during drilling operations and will divert fluid into an annular space as the fluid in the drill string is moving toward the drill bit.

In the construction of oil and gas wells, a wellbore is drilled into one or more subterranean formations or zones containing oil and/or gas to be produced. The wellbore is typically drilled utilizing a drilling rig which has a rotary table on its floor to rotate a pipe string during drilling and other operations. During a wellbore drilling operation, drilling fluid (also called drilling mud) is circulated through a wellbore by pumping it down through the drill string, through a drill bit connected thereto and upwardly back to the surface through the annulus between the wellbore wall and the drill string. The circulation of the drilling fluid functions to lubricate the drill bit, remove cuttings from the wellbore as they are produced and exert hydrostatic pressure on the pressurized fluid containing formations penetrated by the wellbore to prevent blowouts.

In most instances, after the wellbore is drilled, the drill string is removed and a casing string is run into the wellbore while maintaining sufficient drilling fluid in the wellbore to prevent blowouts. The term "casing string," or casing is used herein to mean any string of pipe which is lowered into and cemented in a wellbore including but not limited to surface casing, liners and the like. As is known in the art, the term "liner" simply refers to a casing string having a smaller outer diameter than the inner diameter of a casing that has already been cemented into a portion of a wellbore.

A wellbore may have more than one casing or liner cemented therein. For example, a wellbore may have a casing cemented therein, and a first liner cemented therein below the casing. In some cases, it may be desirable to drill below the first liner, and cement a second liner in the well below the first liner. The wellbore below the first liner may be drilled with a drill bit, or other cutting apparatus attached to the second liner.

The second liner will be lowered into the well with a drill string, which in most cases will have an outer diameter smaller than the outer diameter of the second liner. Drilling fluid will be displaced through the drill string, the second liner, and the cutting apparatus, and will travel up the annulus between the second liner and the wellbore, and into the annulus between the first liner and the second liner. The drilling mud will pass into and upwardly to the annulus between the drill string and the first liner, and the drill string and the casing.

The drilling mud is used to remove drill cuttings and solids by carrying the drill cuttings and solids upwardly to the surface. The size of the annulus or space between the casing and the drill string is greater than the size of the annular space between the first liner and the second liner, and the size of the annulus between the drill string and the first liner is greater than the annulus between the first liner and the second liner. The rate of flow of drilling fluid, in many cases, may not be sufficient to ensure that the drill cuttings and solids are removed from the annular space between the casing and the drill string and/or the drill string and first liner. Thus, there is a need for an apparatus and method that will ensure adequate solids removal in such circumstances.

SUMMARY

The diverter tool of the present invention comprises a diverter body adapted to be connected in a pipe string, which may be a drill string. The pipe string, including the diverter tool, may be used to lower a liner into the wellbore when the liner is utilized to drill the wellbore. The diverter tool will divert a portion of drilling fluid traveling through the pipe string to a cutting apparatus, such as a reamer shoe on the end of the liner, into an annular space around the diverter tool. The diverter tool is preferably utilized when the liner to which the pipe string is attached is used to drill a wellbore below a previously installed casing.

The diverter body defines a longitudinal flow passage and also defines a plurality of diverter ports which intersect the longitudinal flow passage and communicate the longitudinal flow passage with an annular space around the diverter body. A closure member is disposed in the diverter body and is movable from a first or open position to a second or closed position. In the open position, communication through the diverter ports is permitted so that drilling fluid may pass through the diverter ports into the annular space around the diverter tool. In the closed position, the closure member blocks flow and prevents communication through the diverter ports. The diverter ports may have nozzles connected therein. In one embodiment, the closure member comprises a closure sleeve detachably connected in the diverter body with shear pins or other means known in the art.

A setting sleeve may be utilized to move the closure sleeve from its first position to its second position. The setting sleeve may comprise a tubular member defining a flow passage and a rupturable member to block or prevent flow through the flow passage until the burst pressure of the rupturable member is reached. The setting sleeve may be displaced through the pipe string so that it will engage the closing sleeve. Once the setting sleeve engages the closing sleeve, pressure is increased to break the shear pins and move the closing sleeve to its second or closed position. Pressure may be increased again to the burst pressure of the rupturable member to establish flow through the setting sleeve and the closure sleeve.

DETAILED DESCRIPTION

Figure 1:
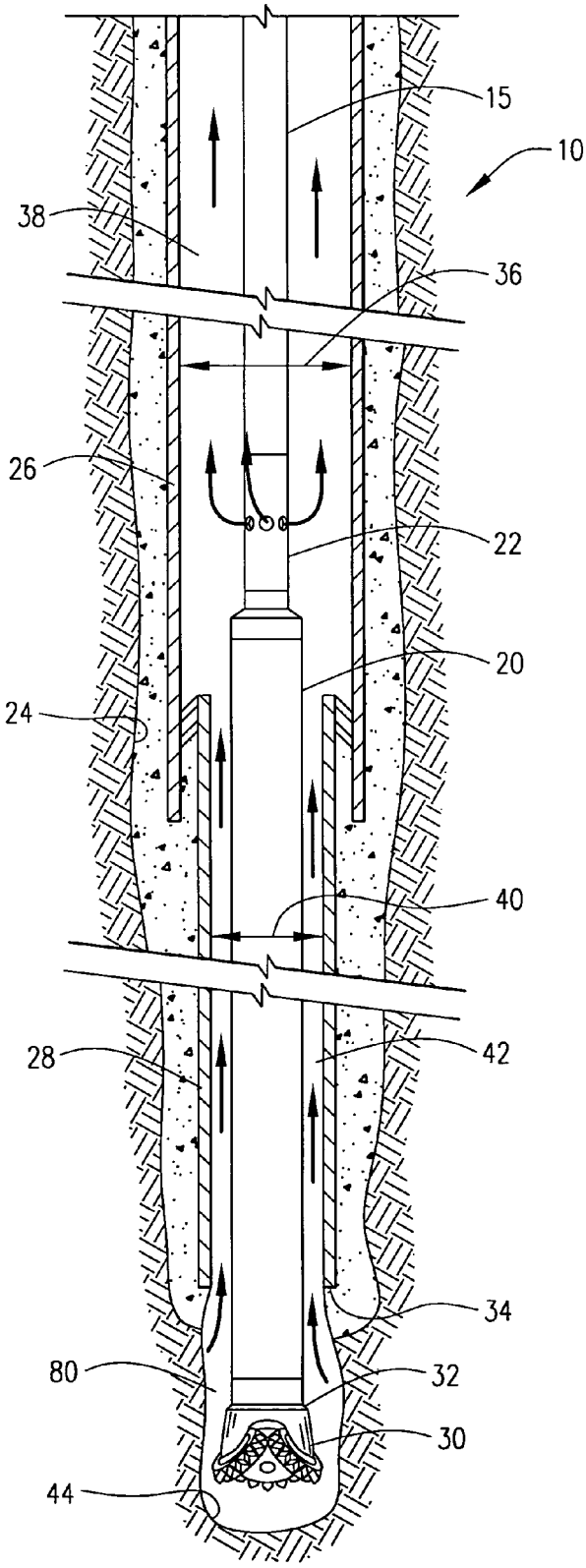
FIG. 1 schematically shows a second liner being lowered through a casing and a first liner and drilling a wellbore below the first liner.

FIG. 1 shows a well 10 with a pipe string or drill string 15 disposed therein lowering a second liner 20 in a well 10. A diverter tool 22 of the current invention is schematically shown connected in drill string 15. Well 10 may comprise wellbore 24 having casing 26 and first liner 28 cemented therein. A cutting device 30, which may be, for example, a reamer shoe or drill shoe 30, may be attached to the lower end 32 of second liner 20 and may be utilized to drill wellbore 24 and extend wellbore 24 below lower end 34 of first liner 28, and through a formation from which fluids are to be produced.

Casing 26 has an inner diameter 36 and a first annulus, or first annular space 38 is defined by and extends between drill string 15 and casing 26. First liner 28 has an inner diameter 40 which is smaller than inner diameter 36. A second annulus, or second annular space 42 is defined by second liner 20 and first liner 28. As is apparent from the drawings, drill string 15 may be lowered so that diverter tool 22 is located in first liner 28, so that an annular space will be defined between diverter tool 22 and first liner 28. The portion of wellbore 24 being drilled below lower end 34 of first liner 28 may be referred to herein as wellbore extension 44. As wellbore extension 44 is being drilled with reamer shoe 30, drilling fluid, as designated by the arrows in FIG. 1, will be displaced through drill string 15 and second liner 20 and will exit at the lower end 32 of second liner 20, and may exit through reamer shoe 30. Fluid will pass upwardly in wellbore extension 44, second annulus 42 and first annulus 38. Because first annulus 38 is larger than second annulus 42, the flow rate of drilling fluid through second annulus 42 may not be sufficient to remove the cuttings from first annulus 38. The same condition may occur in the annular space that will be defined between drill string 15 and first liner 20 when the depth of drill string 15 is such that diverter tool 22 is in first liner 28. Thus, drill string diverter tool 22 provides for the diversion of drilling fluid into an annular space, such as first annulus 38 above second liner 20 to more efficiently remove drill cuttings and solids.

Figure 2:
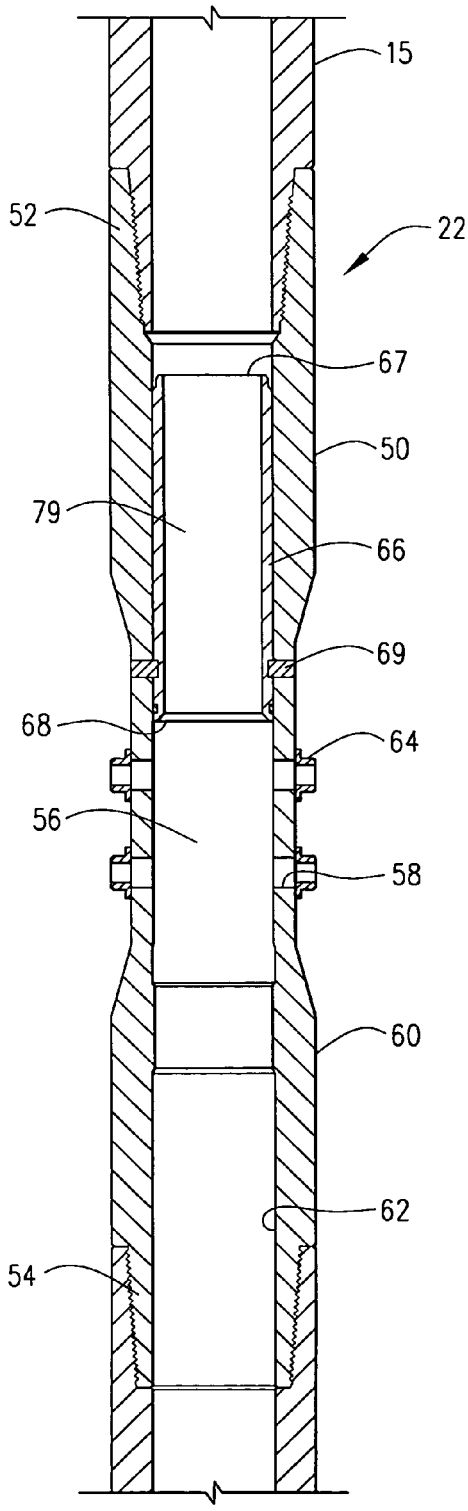
FIG. 2 shows the diverter tool of the present invention in an open or run-in position.
Figure 3:
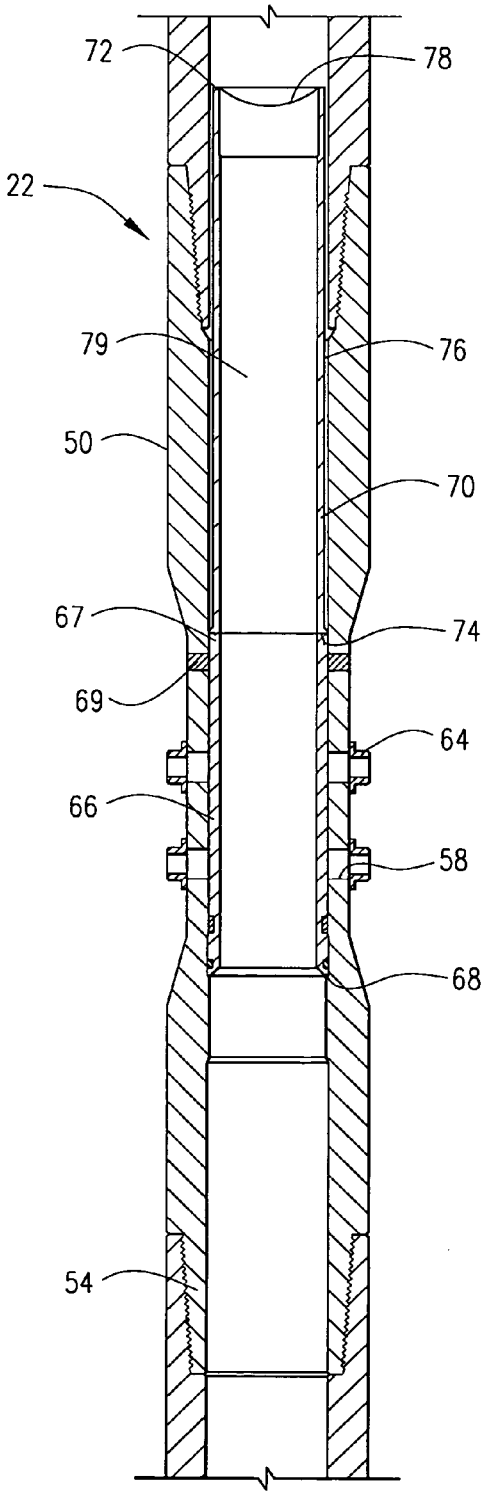
FIG. 3 shows a diverter tool of the present invention in a closed position.
Figure 4:
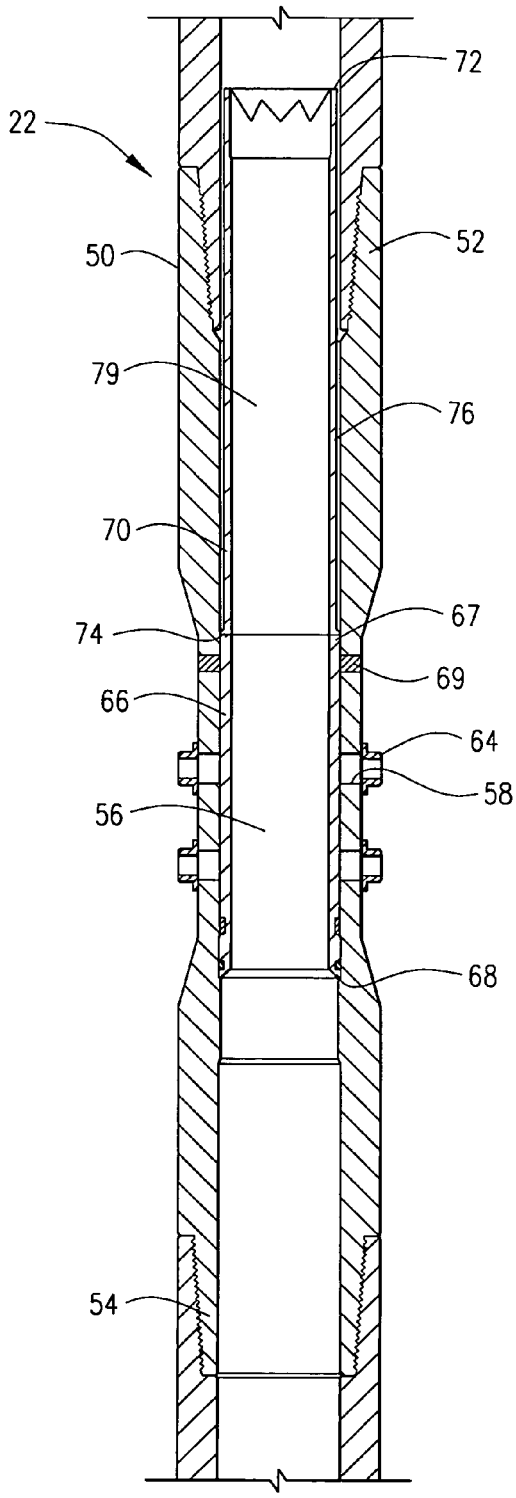
FIG. 4 shows a diverter tool of the current invention in a closed position with the rupturable upper end of a setting tool ruptured to allow releasing darts, balls and fluid to pass therethrough.

Referring now to FIGS. 2-4, diverter tool 22 comprises a diverter body or diverter housing 50 having upper end 52 and lower end 54. Upper and lower ends 52 and 54 are adapted to be connected in drill string 15 and thus may include internal threads at upper end 52 and external threads at lower end 54, or may utilize other connection means known in the art. Diverter body 50 defines longitudinal flow passage 56 and has a plurality of diverter ports 58 therethrough which intersect longitudinal flow passage 56 and will communicate longitudinal flow passage 56 with the annular space around outer surface 60 of diverter body 50, which also has an inner surface 62. Nozzles 64 may be connected to the diverter body at diverter ports 58. Nozzles 64 are attached in such a way as to be replaceable, or changeable so that the flow area through nozzles 64 can be selectively modified to adjust for desired pressure drops or volumes of flow through nozzles 64.

A closure member 66, which may be referred to as an inner sleeve or closing sleeve 66, is disposed in diverter body 50. Closing sleeve 66 has an upper end 67 and a lower end 68. Closing sleeve 66 is detachably connected to diverter body 50 in its first or open position in which flow may be communicated from longitudinal flow passage 56 to an annulus around diverter body 50, such as first annulus 38, through diverter ports 58 and nozzles 64. Closing sleeve 66 may be detachably connected with, for example, shear pins 69.

A setting sleeve or setting tool 70 may be displaced through drill string 15 until it engages upper end 67 of closing sleeve 66. Setting tool 70 has upper end 72 and lower end 74. Setting tool 70 comprises a tubular member, or tubular body 76 and has a rupturable member 78 which may be a rupture disk 78 disposed at the upper end 72 to prevent flow through a flow passage 79 defined by tubular body 76. The burst or rupture pressure will exceed the pressure required to shear shear pins 69 which detachably connect closing sleeve 66 in its open position as shown in FIG. 2. FIG. 3 shows diverter tool 22 after pressure has been increased and shear pins 69 have been sheared so that in FIG. 3, closing sleeve 66 is in a closed position in which it blocks diverter ports 58 to prevent communication therethrough. When it is desired to rupture rupturable member 78, pressure in drill string 15 is increased until a burst pressure of rupturable member 78 is reached. When rupturable member 78 is ruptured, full bore flow through setting tool 70 and closing sleeve 66 is established.

The operation of the invention is evident from the drawings. Drill string 15 is utilized to lower second liner 20 through casing 26 and first liner 28. Reamer shoe 30 is attached to lower end 32 of second liner 20 and will be utilized to drill wellbore extension 44 by means known in the art. Drilling fluid, also referred to as drilling mud is displaced through drill string 15 and second liner 20 until it exits second liner 20 through reamer shoe 30. The drilling fluid will pass upwardly in an annulus 80 between wellbore extension 44 and second liner 20 and likewise through second annulus 42 between first liner 28 and second liner 20. Drilling fluid will move drill cuttings and solids upwardly so that they are removed from well 10. In order to more efficiently remove drill solids and cuttings, the diverter tool 22 provides additional flow in first annulus 38 between casing 26 and drill string 15. A portion of the drilling mud flowing through drill string 15 towards reamer shoe 30 will exit diverter tool 22 through diverter ports 58 and nozzles 64 and will generate a flow rate sufficient to more efficiently remove the drill solids and cuttings from first annulus 38. Nozzles 64 may be sized to achieve a desired pressure drop or volume therethrough. The invention provides for more efficient removal of the cuttings since flow through reamer shoe 30 may not be sufficient to remove drill solids and cuttings from first annulus 38 since first annulus 38 is larger than second annulus 42 and a greater volume of flow may be required. Generating flow through reamer shoe 30 at a rate sufficient to create the necessary volume of flow may create a pressure in the well that will cause the formation to break down. The necessary volume is therefore generated by flow of drilling fluid through reamer shoe 30 and the portion of the drill fluid that exits diverter tool 22 into first annulus 38, which moves the drill cuttings and solids upwardly so that they can be removed from well 10.

Once reamer shoe 30 reaches the desired depth, setting tool 70 may be displaced through drill string 15 until it engages closing sleeve 66. Pressure is increased to shear shear pins 69, and move setting tool 70 from the open position shown in FIG. 2 to the closed position shown in FIG. 3. Pressure is again increased until it exceeds the burst pressure of rupturable member 78, to establish a full bore flow passage through setting tool 70 and closing sleeve 66. Cementing operations can then be performed. Because full bore flow is established, drill pipe wiper darts and plugs used to launch cement plugs that may be positioned in liner 20 can pass therethrough. In other words, liner 20 may have fill apparatus such as that shown in U.S. Pat. No. 5,641,021 to Murray et al., which is incorporated herein by reference in its entirety, and may include float equipment such as a float collar since wiper darts and plugs utilized to launch the cement plugs may be used in connection with diverter tool 22.

Thus, the present invention is well adapted to carry out the object and advantages mentioned as well as those which are inherent therein. While numerous changes may be made by those skilled in the art, such changes are encompassed within the spirit of this invention as defined by the appended claims.

What is claimed is:

1. An apparatus for drilling a wellbore and cementing a liner therein, comprising:

a pipe string connected to the liner, wherein the liner has a cutting apparatus on a lower end thereof;

a diverter tool connected in the pipe string, the diverter tool defining a longitudinal flow passage and diverter ports intersecting the longitudinal flow passage, wherein a portion of a drilling fluid displaced through the diverter tool toward the liner is diverted through the diverter ports into an annular space around the diverter tool above the liner, the diverter tool including a closure member, the closure member comprising a closing sleeve detachably connected in the diverter tool and disposed in the diverter tool and being movable from an open position wherein communication through the diverter ports from the longitudinal flow passage is permitted, to a closed position wherein the closure member blocks the diverter ports; and a setting tool for moving the closing sleeve from the open position to the closed position, wherein the setting tool comprises:

a tubular member for engaging the closing sleeve; and a rupturable member for preventing flow through the tubular member until a burst pressure of the rupturable member is reached.

2. An apparatus for drilling a wellbore below a casing installed in a well, comprising:

a pipe string;

a liner connected to the pipe string;

a cutting apparatus connected to the liner for drilling the wellbore;

a diverter tool, wherein the diverter tool diverts a portion of a drilling fluid traveling through the pipe string in a direction toward the cutting apparatus during drilling with the cutting apparatus into an annular space around the diverter tool, the diverter tool comprising:

a diverter body adapted to be connected in the pipe string, the diverter body defining a longitudinal flow passage and a plurality of diverter ports to communicate the longitudinal flow passage with the annular space; and a closure member disposed in the diverter body, wherein the closure member is axially movable from a first position wherein communication through the diverter ports is permitted, to a second position wherein the closure member blocks flow and prevents communication through the diverter ports; and a setting tool for axially moving the closure member from its first position to its second position, the setting tool comprising:

a tubular body receivable in the diverter body; and a rupturable member extending across a flow passage defined by the tubular body to prevent flow therethrough, wherein pressure in the pipe string may be increased to detach the closure member from the diverter body, so that the setting tool can move the closure member from its first position to its second position.

3. The apparatus of claim 2 wherein the annular space comprises an annulus between the diverter tool and the casing.

4. The apparatus of claim 3 wherein the closure member comprises a closing sleeve detachably connected in its first position in the diverter body.

5. The apparatus of claim 4 wherein pressure in the pipe string may be increased to the burst pressure of the rupturable member to burst the rupturable member and provide full bore flow through the setting tool after the closing sleeve is in its second position.

6. The apparatus of claim 2 further comprising nozzles connected to the diverter body at the diverter ports.

7. The apparatus of claim 6 wherein the nozzles are changeable, so that volume of fluid flowing through the nozzles can be regulated.

8. A method of drilling a wellbore below a portion of a well having a casing therein, comprising:

connecting a pipe string to a liner;

lowering the liner through the casing with the pipe string, wherein the liner has a cutting apparatus connected thereto;

drilling the wellbore below the casing with the cutting apparatus attached to the liner;

displacing a drilling fluid through the liner and the cutting apparatus as the wellbore is being drilled;

diverting a portion of the drilling fluid into the casing through a plurality of diverter ports in a diverter tool connected in the pipe string above the liner being lowered through the casing;

axially moving a setting tool, the setting tool comprising a tubular member for engaging a closing sleeve and a rupturable member for preventing flow through the tubular member, wherein axially moving the setting tool moves the closing sleeve in the diverter tool to block flow through the diverter ports after the wellbore has been drilled to its desired depth with the cutting apparatus attached to the liner; and increasing a pressure in the pipe string until a burst pressure of the rupturable member is reached, wherein flow the tubular member is established.

9. The method of claim 8 further comprising after bursting the rupturable member is displacing a cementing fluid through the liner and the cuffing apparatus to cement the liner in the wellbore drilled below the casing installed in the well.

10. The method of claim 8 further comprising detachably connecting the closing sleeve above the diverter ports.

* * * * *